US005676274A

United States Patent [19]

Green et al.

[11] Patent Number: 5,676,274

[45] Date of Patent: Oct. 14, 1997

[54] ROLLABLE STORAGE DEVICE HAVING MULTIPLE COMPARTMENTS

[75] Inventors: Dwight C. Green, Ashburn; Ingo F. M. Van Styn, Spotsylvania, both of Va.

[73] Assignee: Euromart Media International Inc., Fredericksburg, Va.

[21] Appl. No.: 624,888

[22] Filed: Mar. 27, 1996

[51] Int. Cl.[6] ..... B65D 37/00

[52] U.S. Cl. ..... 220/520; 220/507; 220/505; 220/23.86; 220/23.8

[58] Field of Search ..... 220/520, 507, 220/505, 522, 6, 7, 23.86, 23.4, 23.8, 503; 206/390, 820

[56] References Cited

U.S. PATENT DOCUMENTS

| | | | |
|---|---|---|---|
| 783,059 | 2/1905 | Miller | 220/23.83 |
| 2,878,928 | 3/1959 | Ivy | 206/390 |
| 3,245,528 | 4/1966 | Holley . | |
| 3,319,685 | 5/1967 | Urban . | |
| 3,386,607 | 6/1968 | Keene | 220/520 |
| 3,605,374 | 9/1971 | Mueller et al. . | |
| 3,835,992 | 9/1974 | Adams, IV . | |
| 3,992,810 | 11/1976 | Kimball | 220/23.8 |
| 4,320,846 | 3/1982 | Meyering et al. . | |
| 4,627,595 | 12/1986 | Rhodes et al. . | |
| 4,799,590 | 1/1989 | Furman | 206/820 |
| 4,890,741 | 1/1990 | Edelstein | 220/520 |
| 5,135,823 | 8/1992 | Eales | 220/23.83 |
| 5,370,255 | 12/1994 | Yang | 220/520 |

*Primary Examiner*—Stephen J. Castellano

*Attorney, Agent, or Firm*—Sixbey, Friedman, Leedom & Ferguson; Daniel W. Sixbey

[57] ABSTRACT

A rollable storage device having a plurality of compartments for storing objects therein. Each compartment includes a bottom wall and outwardly extending side walls and end walls, and an open upper side. Each of the compartments includes a different cross-sectional shape. The bottom walls of the compartments are hingedly interconnected to form a unitary continuous row of compartments with at least a majority of the bottom walls formed from a unitarily molded sheet of plastic which extends beneath a majority of the compartments, wherein the hinges are formed from same single sheet of plastic as the bottom walls. The row of compartments is rollable between a first extended open position in which the compartments rest on their bottom walls with the upper sides of the compartments turned upwardly, and a second, rolled-up closed position in which the row of compartments has been spirally wound from the open position to form a substantially closed block of hexagonal shape. Each of the open upper compartment sides is matingly covered by the bottom wall of a compartment situated radially inwardly thereof in the spirally wound block. The end walls in a majority of the compartments include an elongated flange extending across the top surface of the end wall which is fitting received within corresponding elongated groove formed in a lower side of the corresponding end wall of a compartment lying inwardly of in the spirally wound block.

6 Claims, 3 Drawing Sheets

ROLLABLE STORAGE DEVICE HAVING MULTIPLE COMPARTMENTS

BACKGROUND OF THE INVENTION

1. Technical Field

This invention relates to an improved portable storage device having multiple compartments. More particularly, the multiple compartments of the improved storage device are hingedly interconnected to form a continuous row of compartments which are rollable to form a hexagonal closed device.

2. Background Art

Containers for storing loose objects have been manufactured with a variety of constructions and features for organizing different groups of loose objects. Such containers often utilized multiple compartments for allowing loose objects to be organized therein; for example, tool boxes containing trays with divisional walls formed therein to define multiple compartments. These containers, however, have not been concerned with the problems encountered when the containers are utilized as portable devices, such as the loose objects falling out of their respective compartment if the container is inadvertently knocked over. Therefore, containers were developed having multiple compartments which substantially sealed the compartments when the container was closed, thus allowing the container to be freely portable.

U.S. Pat. No. 4,320,846 issued to Meyering et al. discloses one such multiple-compartment storage device. The container includes a plurality of container elements positioned to form a row of elements when the container is in a open state. The elements have cross-sectional shapes so adapted to one another that the row of elements can be spirally rolled-up from one end of the row to form a block of prismatic form. At least the majority of the container elements have open upper sides opposite their base walls, wherein the open upper sides of the container elements in the rolled-up position are closed-off by wall portions of other elements lying inwardly thereof in the spirally wound block with the wall portions engaging the open sides. The container elements are not formed together, but rather are separately formed and interconnected by a pair of flexible strips which run parallel to one another across the undersides of the bottom walls to which they are adhesively affixed. The flexible strips serve to hingedly interconnect the container elements allowing the elements to be spirally wound. These flexible strips, however, do not provide a stable connection between the container elements and tend to allow the container elements to shift with respect to each other. Furthermore, the flexible strips tend to weaken and stretch over time, wherein the wear and tear on the storage device from substantial use also causes the adhesive bond between the flexible strips and the bottom walls of the container elements to deteriorate. These aforementioned problems associated with the flexible strips allow the container elements to move in a lateral direction along the direction of the hinge axis between container elements, with this shifting movement worsening over time. Therefore, this shifting of the container elements causes the elements to become misaligned with one another, and it becomes increasingly more difficult to spirally roll the mating container elements together.

Each of the container elements in the Meyering et al. storage device further include a locking mechanism to oppose premature opening of the spirally wound row of container elements. The locking mechanism comprises a curved projection formed on the upper edges of each of the end walls of the container elements, where the projection extends obliquely upwardly in the direction in which the row is unrolled. In the rolled-up position, the projection is fittingly received in a recess formed in the underside of the corresponding end wall of the container element situated radially inwardly thereof. The container elements must be maintained in precise alignment during rolling of the row of container elements in order to ensure that the projections are properly received within their mating recesses. However, as discussed above, the container elements in the Meyerlug et al. storage device tend to shift with respect to each other which places the container elements in misalignment causing the projections to not properly fit within their respective recesses. Once again, the misaligned projections make it increasingly more difficult to spirally roll the mating container elements together.

While the separate container elements of the Meyerlug et al. storage device may comprise different heights, the height of the side walls of each individual container element is equal to the height of the individual container element's end walls. Therefore, the upper edges of the side walls and end walls of each individual container element lie in a single plane which engages the bottom wall of a container element situated radially inward thereof. When loose objects placed within these container elements are stacked above the plane of the upper edges of a container element, the bottom wall of the radially-inwardly positioned container element cannot lie flat against the upper edges of the radially-outwardly positioned container element. The projection from one container element will not properly fit within its respective recess in another container element unless the upper edges of the one container element lie flat against the bottom wall of the other container element. Thus, overfilling a container element past the plane of the upper edges will cause the projection from the overfilled container element to become misaligned with its respective recess which will further inhibit the container elements from being spirally rolled together into a closed storage device.

The first two container elements of the row of container elements in the Meyering et al. storage device do not have their open upper sides covered by the bottom wall of another container element. Rather, the first two container elements are hingedly connected so that their open upper sides matingly engage, which allows these first two container elements enclose a relatively large space therein. However, this arrangement allows the loose objects stored within these first two compartments to move around between both compartments as the storage device is moved, which can cause the loose objects to become in disarray and settle near the opening between the two container elements. When the storage device is unrolled, these loose objects may then tend to fall out of the container elements as they are separated from one another.

Therefore, as can be seen from the foregoing, there is a need for a rollable storage device having multiple compartments where the compartments retain proper alignment with respect to one another in light of the harsh conditions portable storage devices may undergo. Furthermore, there is a need for a rollable storage device having greater support for the multiple compartments in order to resist misalignment of the compartments which allows the compartments to remain easily rollable.

SUMMARY OF THE INVENTION

It is an object of the present invention to overcome the aforementioned shortcomings associated with the prior art.

Another object of the present invention is to provide a rollable storage device having multiple storage compartments shaped and positioned such as to minimize the size of the overall rollable storage device.

Yet another object of the present invention is to provide a rollable storage device having compartments which easily engage with one another while the storage device is spirally wound.

It is yet another object of the present invention is to provide a rollable storage device having compartments which resist becoming misaligned with one another, even while the storage device is spirally wound under imperfect conditions.

It is a further object of the present invention is to provide a rollable storage device having compartments which do not shift along the longitudinal axis of the hinge between compartments with respect to adjacent compartments.

Yet a further object of the present invention is to provide a rollable storage device which is shaped such that a larger percentage of the rollable storage device exists in the lower half of the device than the upper half in order to provide a more stable base for the storage device.

Still another object of the present invention is to provide a rollable storage device having multiple compartments having end walls designed to provide more stable supporting structure for the rollable storage device.

It is a further object of the present invention is to provide a rollable storage device having multiple compartments with end walls designed to allow the storage device to be easily spirally wound even when some of the compartments are overfilled with the objects being stored.

These as well as additional objects and advantages of the present invention are achieved by providing a rollable storage device having a plurality of compartments for storing objects therein. Each compartment includes a bottom wall, a pair of side walls, and a pair of end walls with the pair of side walls and end walls extending outwardly from the bottom wall. Each of the end walls are substantially parallel to and have a height equal to the other end wall of the pair of end walls within each compartment, wherein a minority of the compartments have end walls with the same height as the end walls of other compartments. The pair of end walls in each compartment have a height greater than the height of the pair of side walls in the same compartment.

The bottom walls of the compartments are hingedly interconnected to form a unitary continuous row of compartments with at least a majority of the bottom walls formed from a unitarily molded sheet of plastic material which extends beneath a majority of the compartments. The plurality of compartments have open upper sides opposite their bottom wall. The row of hingedly interconnected compartments have a first end and a second end. The row of compartments is rollable between a first extended open position in which the compartments rest on their bottom walls with the upper sides of the compartments turned upwardly, and a second, rolled-up closed position in which the row of compartments, beginning from the first end, has been spirally wound from the first position to form a substantially closed block of hexagonal shape. Each of the compartments is turned toward the first end and is in abutting relation to the adjacent compartment hingedly connected thereto, and each of the open upper compartment sides is matingly covered by the bottom wall of a compartment situated radially inwardly thereof in the spirally wound block.

Each of the end walls of the compartments, except for the first two compartments at the first end of the row of compartments, include an elongated ridge extending across the majority of the length of the end wall, wherein the elongated ridge has a thickness less than the thickness of the end wall. The elongated ridges are received within corresponding elongated slots formed in a lower side of the corresponding end wall of a compartment lying inwardly of and abutting the ridge containing compartment in the spirally wound block. The elongated ridges and elongated slots are shaped so as to engage one another when the row of compartments is rolled up and to disengage when the row of compartments is unrolled.

These as well as additional advantages of the present invention will become apparent from the following description of the invention with reference to the several figures.

DETAILED DESCRIPTION OF THE INVENTION

Figure 1:
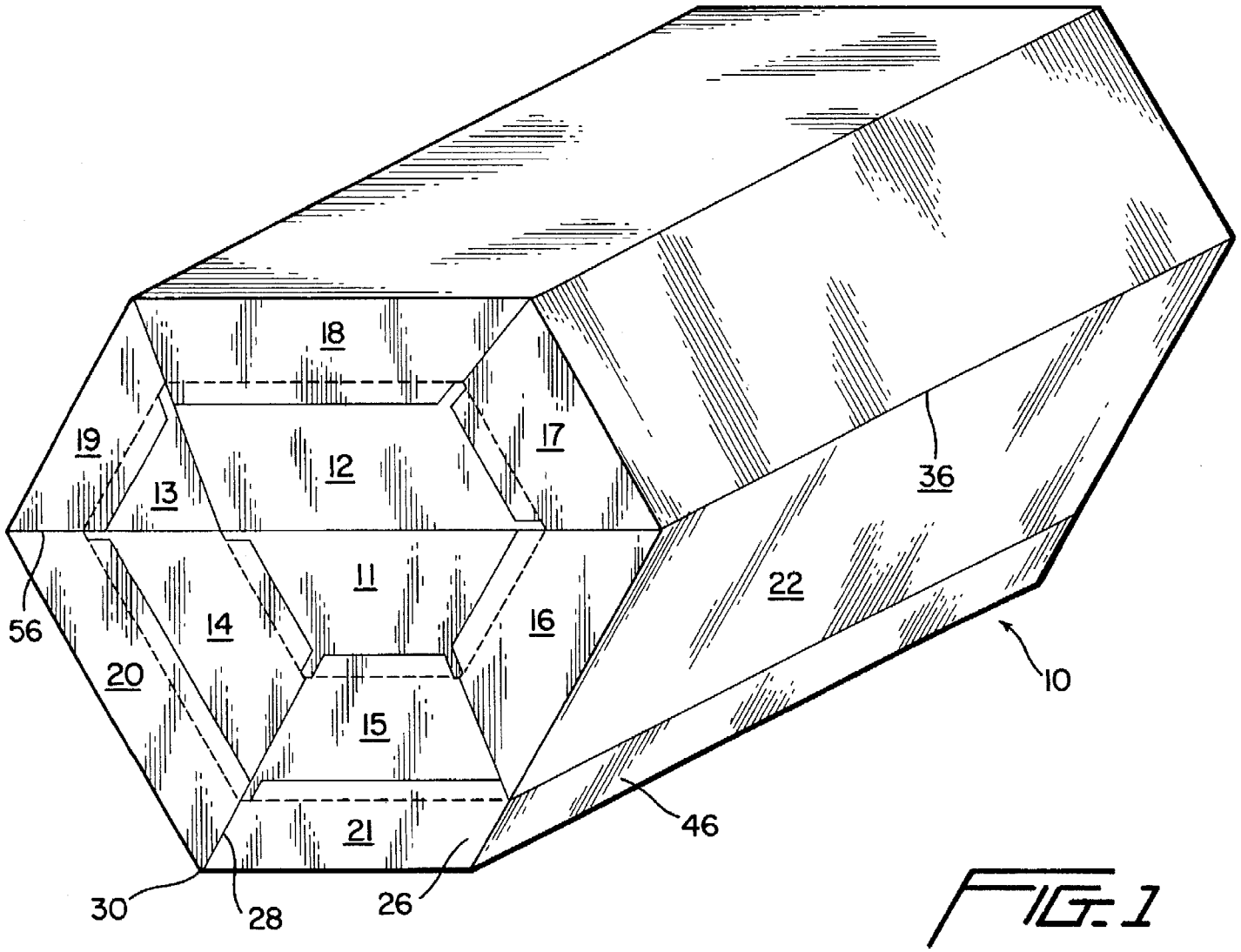
FIG. 1 is a perspective view of the rollable storage device in a spirally wound state in accordance with an alternative embodiment of the present invention.
Figure 2:
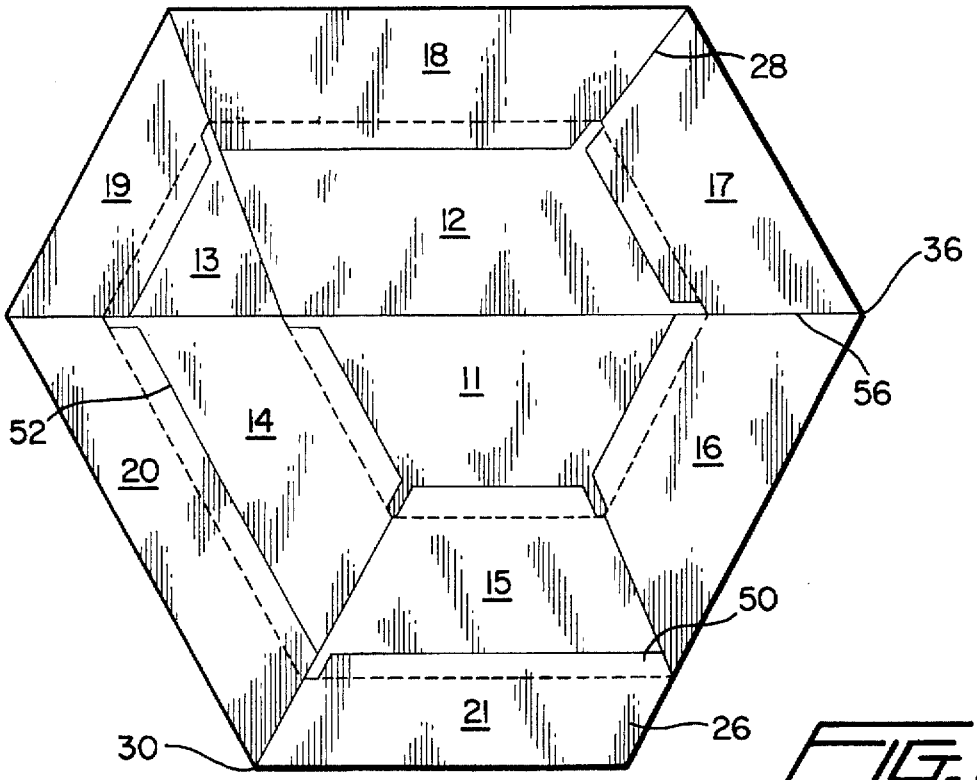
FIG. 2 is a side view of the rollable storage device in a spirally wound state in accordance with an alternative embodiment of the present invention.
Figure 3:
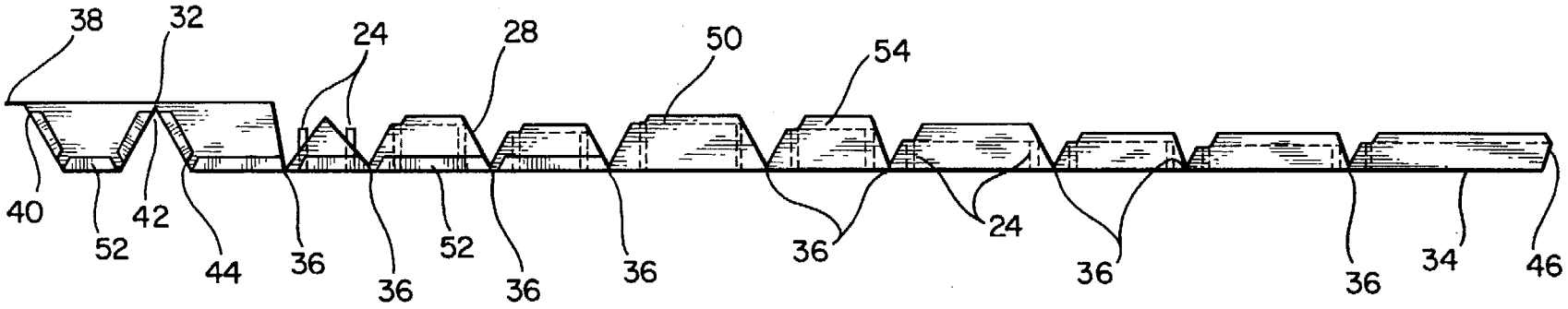
FIG. 3 is a side view of the rollable storage device showing the row of compartments in an unrolled state in accordance with the alternative embodiment of the present invention.

Referring now to FIGS. 1–3, the rollable storage device 10 is illustrated having compartments 11–21 of equal length but of differing cross-sections and depths. The compartments 11–21 include a flat rectangular bottom wall 22 extending across the bottom surface of each compartment. Each compartment further includes a pair of side walls 24 (shown in broken lines in FIG. 3) and a pair of end walls 26 extending upwardly from bottom wall 22, wherein the end walls determine the different sectional forms of the compartments 11–21. The side walls 24 extend the full length of the compartment from end wall to end wall. The side walls 24 may either extend vertically in a direction perpendicular to the bottom wall 22, as shown, or the side walls 24 may be attached to the side edges 28 of the end walls 26 so that the side walls 24 and side edges 28 slope away from the bottom wall 22 in the same direction.

All of the compartments 11–21 are hingedly interconnected, where compartments 12–21 are interconnected through the side edges 30 of the bottom walls 22 to the compartments adjacent thereto and compartments 11 and 12 are interconnected at the uppermost portion by a hinge 32 between the adjacent side walls 24. In one embodiment of the present invention, the bottom walls 22 of the compartments 12–21 are formed from a single, unitarily molded sheet of flexible plastic material 34 which is reduced in thickness and scored at regions 36 to form a "living hinge." The segments of plastic material 34 located between scored regions 36 serve to form the bottom walls 22 of the different compartments 12–21. Since the scored regions 36 are much thinner than the rigid bottom walls 22, the bottom walls 22 may be folded toward one another about the integral thinner scored regions 36. Therefore, scored regions 36 act as hinges between the bottom walls 22, although the hinges 36 and bottom walls 22 are made of the same flexible plastic material. The hinges 36 function as a pivotal axis between the compartments 11–21 to be folded together from the unitary row of compartments, shown in FIG. 3, into a closed hexagonal block, shown in FIG. 1.

Each of the compartments 11–21 are shaped with a sectional form which allows the row of compartments to be spirally wound into a closed block. The sectional form of the first compartment 11 is trapezoidal and the second compartment 12 is that of a parallelogram. Compartments 14–20 are also trapezoidal in shape with the last compartment 21 also having the shape of a parallelogram, while compartment 13 is triangular. Each and every compartment has a different cross-sectional shape, where the upper side of each compartment 11–21 is open.

The hinges 32 and 36 and the different sectional forms of the compartments 11–21 allow the unitary row of compartments to be spirally rolled into a closed block. In achieving this, first the compartment 11 is pivoted on the hinge 32, which is also preferably a unitary living hinge, to fittingly engage with the open upper side of the compartment 12, wherein compartments 11 and 12 form in this position the core of the storage device 10 or the inner-most winding of the spirally wound block. Thus, the compartments 11 and 12, when engaging one another by their open sides, enclose a relatively large space which can serve as storage space for larger objects than the other compartments could hold.

The subsequent second winding of the spirally wound block comprises the triangular compartment 13, which includes the smallest compartment of the storage device 10, and the following compartments 14, 15, 17 and 18 which all have different trapezoidal cross-sections. During the rolling-up of the compartments 11–21, the side edge 28 of the end wall 26 of compartment 12 comes to abut the adjoining side edge 28 of the end wall 26 of compartment 13 while a sideways extending lip 38 formed on the side wall 40 of compartment 11 engages with the upper edge of the rear side wall 24 of the compartment 13. Through this, the small storage space in compartment 13 is covered-off on its upper side. By further rolling up the row of compartments, the open upper sides of 14, 15 and 16 are respectively and configuratively covered-off by the outermost side wall 40 of compartment 11, the bottom wall 22 of compartment 11, and the other side wall 42 of compartment 11, while compartments 17 and 18 are covered-off by the side wall 44 and the bottom wall 22 of compartment 12, respectively.

The outermost winding of the spirally-wound block includes compartments 19, 20 and 21. These compartments are wider than the respective radially-inwardly positioned compartments to provide a more stable base for the storage device. The open upper sides of compartments 19, 20 and 21 are covered-off by the bottom walls 22 of compartments 13, 14 and 15, respectively. The bottom walls 22 of the compartments 17, 18, 19, 20 and 21 constitute five of the six side surfaces of the hexagonal block, where the sixth side is formed by the outwardly sloping side wall 46 of compartment 21 and the bottom wall 22 of compartment 16.

In addition to providing the cross-sectional shape of the compartments, the end walls 26 of the majority of the compartments also project upwardly above the side walls 24 to provide flanges 50 formed on the upper surfaces of end walls 26. These elongated flanges 50 extend across the majority of the length of the top surface of end walls 26, and in the rolled-up position of the row of compartments 11–21, are fittingly received in elongated cutaway portions or grooves 52 formed in the underside of the corresponding end walls 26 of the compartments situated radially inwardly thereof. Thus, the elongated grooves 52 extend across the majority of the length of the bottom surface of end walls 26. By incorporating flanges 50 and grooves 52 into the end walls 26, most of the support for the compartments in the rolled-up state is carried through the end walls 26. Since the sloping side edges 28 of the side walls 26 of adjacent compartments abut each other as the row of compartments are rolled-up while the top surface of the end walls 26 engage the bottom surface of end walls 26 of the compartment situated radially inwardly thereof, the support provided by the contacting edges of the compartments is critical to ensure a stable foundation for the rollable storage device 10. Therefore, the elongated flanges 50 and grooves 52 formed in the end walls 26 ensure a more stable connection between contacting edges of end walls 26 of adjacent compartments resulting in a more stable supporting structure for the entire storage device 10. Furthermore, the elongated flanges 50 of the outer-situated compartment in the spirally wound block closely fit within the elongated grooves 52 in the compartment situated radially inward thereof, which will resist lateral movement toward either end wall 26 since both end walls 26 of the outer-situated compartment will enclose the abutting inner-situated compartment. The stability of the rollable storage device 10 is further enhanced by the resistance to lateral movement by the compartments toward either end wall 26.

The elongated flanges 50 and grooves 52 also enhance the ease in which the row of compartments is spirally wound into the hexagonal block by allowing the end walls 26 of one compartment matingly engage with the compartment situated radially inwardly thereof. Since the flanges 50 and grooves 52 extend along the majority of the length of the compartments, their interconnection has a large margin of error which allows the two components to easily engage with each other even if the compartments are somehow misaligned.

The elongated flanges 50 are extensions of the end walls 26 and are of a thickness less than the thickness of end walls 26. The thickness of the elongated flanges 50 and, in turn, elongated grooves 52 should be approximately one-half the thickness of end walls 26 in order to ensure proper support without substantially weakening those portions of the end walls 26. The compartments 11–21 having elongated flanges 50 will, accordingly, have end walls 26 having a higher height than the height of the side walls 24 within the same compartment. This can be seen in FIG. 3, where the vertically extending dotted lines show the location of side walls 24 and the horizontally extending side lines 54 show the plane of the top surface of the side walls 24.

As the row of compartments is rolled-up, compartment 11 includes elongated grooves 52 formed in its end wall 26 adjacent to side wall 40, bottom wall 22, and side wall 42 for fittingly receiving elongated flanges 50 extending from compartments 14, 15 and 16, respectively. Compartment 12 includes elongated grooves 52 formed in its end wall 26 adjacent to side wall 44 and bottom wall 22 for fittingly receiving elongated flanges 50 extending from compartments 17 and 18, respectively. Additionally, compartments 13, 14 and 15 includes elongated grooves 52 formed in their bottom walls 22 for fittingly receiving elongated flanges 50 extending from compartments 19, 20 and 21, respectively. The elongated flanges 50 and grooves 52 allow the majority of the support for the compartments 11–21 to extend through the end walls 26 which allows the compartments 11–21 to still easily be spirally wound if one of the compartments is overfilled above the plane extending across the height of the side walls 24.

As described above, all of the compartments 11–21 include different cross-sectional shapes. The height of the compartments preferably becomes gradually smaller moving from compartment 11, the compartment having the greatest height, along the row of compartments toward compartment 21, the compartment having the smallest height. No more than two consecutive compartments 11–21 in the row of compartments have the same height. This gradual decrease in height of the compartments minimizes the effort required to roll the compartments into the spirally wound block, especially when the compartments are filled with heavy objects. The gradually decreasing height of the compartments also provides a more consistent, stable rollable storage device 10, regardless of what is stored in the compartments. Additionally, the variety of cross-sectional shapes used for the compartments 11–21 allows the majority of the storage space in the rollable storage device 10 to be located in the lower half of the block. The upper three sides of the block are separated from the lower sides by the horizontally extending line 56, which is formed by the contacting side edges 28 of the end walls 26 between compartments 13 and 14, 16 and 17, and 19 and 20, and the contacting top surfaces of the end walls 26 between compartments 11 and 12. It is preferred in this embodiment of the present invention that at least 59% of the storage space for rollable storage device 10 is distributed beneath horizontally extending line 56 in order to provide a stable base, which will resist allowing the storage device 10 to be accidentally knocked-over.

Furthermore, having compartments of completely different cross-sectional shapes allows for the most efficient use of space to compactly provide the largest number of compartment. The rollable storage device 10 of the present invention utilizes each and every compartment 11–21 as a storage compartment and does not require a compartment merely to be used as a filler compartment which can not be used a storage compartment in order to assist in properly fitting all of the compartment together into the hexagonal block.

By integrally forming all of the bottom walls 22 of the compartments 11–21 and the hinges 36 between compartments 12–21 from the same unitary sheet of plastic 34, an extremely stable pivotal axis between compartments is provided which will not allow relative movement between the compartments 11–21 other than their pivotal folding. Additionally, the side wall 42 and bottom wall 22 of compartment 11 and the side wall 44 and bottom wall 22 of compartment 12 may also be formed from the same unitary sheet of plastic 34 as the other compartments 13–21. This construction further allows hinge 32 to be similarly formed the unitary sheet of plastic 34 as hinges 36, and all hinges 32 and 36 may be living hinges of the unitary sheet of plastic. Furthermore, the integral formation of the hinges 36 with bottom walls 22 and hinge 32 with side walls 42 and 44 provides a hinge structure which will maintain its rigid connection to the bottom walls 22 over continued use and which will remain easily rollable into the spirally-wound block over time without suffering the detrimental effects of continued use incurred by elastic hinges.

Figure 4:
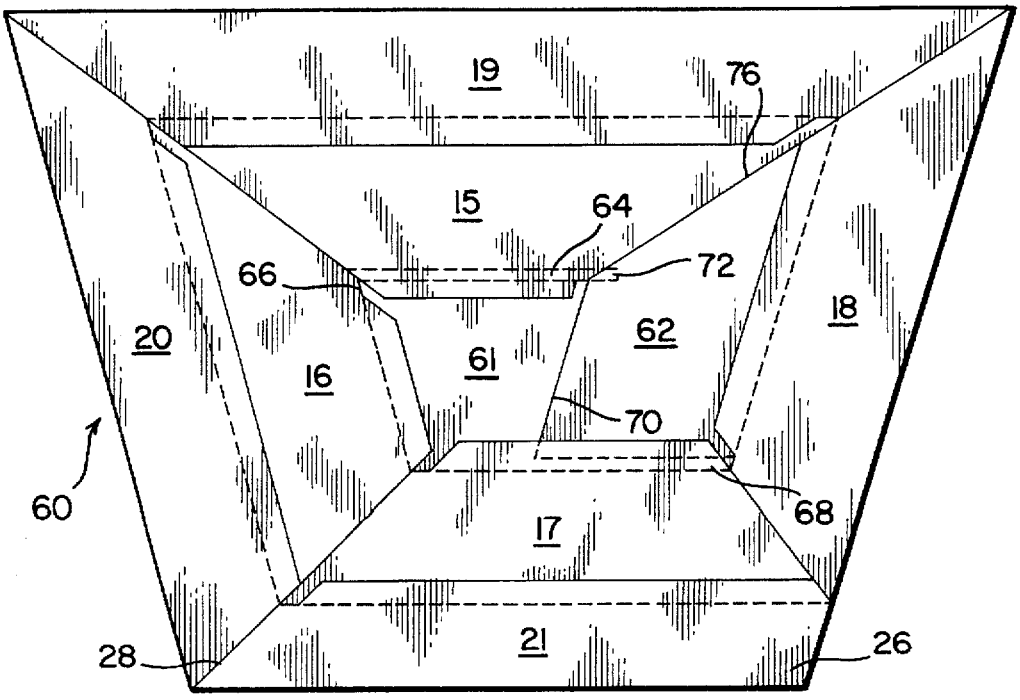
FIG. 4 is a side view of the rollable storage device in a spirally wound state in accordance with the preferred embodiment of the present invention.
Figure 5:
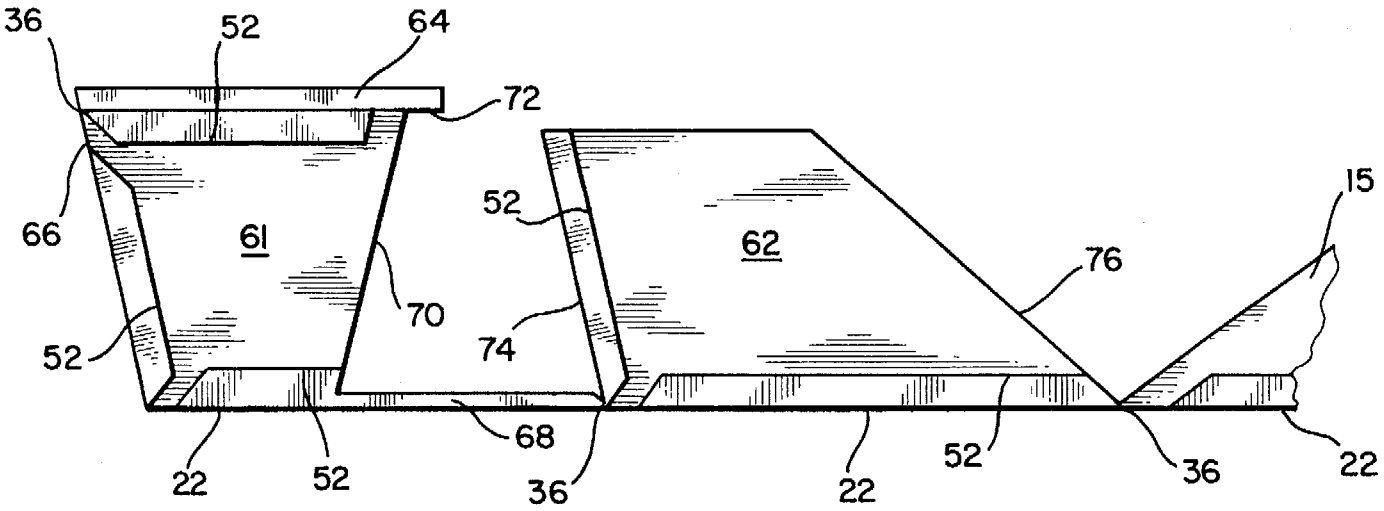
FIG. 5 is a fragmentary side view of the rollable storage device showing the row of compartments in an unrolled state in accordance with the preferred embodiment of the present invention.

Referring now to FIGS. 4 and 5, the preferred embodiment of the present invention is illustrated with a rollable storage device 60 having a four-sided trapezoidal shape. The similarly numbered components of the preferred embodiment function equivalently as discussed in the previously described embodiment. Compartments 15–21 are similar to the previously described compartments 15–21; however, the cross-sectional shape of compartments 15–21 within the preferred embodiment are slightly altered in order to allow the compartments to be spirally wound into a closed trapezoidal block. Compartments 11–14 are eliminated from the previously described embodiment and replaced with compartments 61 and 62.

Compartment 61, the centrally positioned compartment, is also trapezoidal in shape and includes a lid 64 which is hingedly interconnected through a living hinge 36 to the top of the outermost side wall 66 of compartment 61. The lid 64 covers the open upper side opposite to bottom wall 22 of compartment 61. With this arrangement, the central compartment 61 faces upwardly when the rollable storage device 60 is in its spirally wound block. By keeping the central compartment 61 in an upright position at all times, except when the row of compartments are spirally rolled or unrolled, the loose objects placed within compartment 61 are kept distant from the opening end of compartment 61. Therefore, the loose objects stored within compartment 61 are less likely to become in disarray and fall out of the compartment 61 as the compartments are unrolled.

The bottom wall 22 of compartment 61 includes an extension 68 which extends in the plane of the bottom wall 22 beyond the inner most wall 70 of compartment 61, wherein the extension 68 is hingedly attached to the bottom wall 22 of compartment 62 through a living hinge 36. The bottom wall 22 of compartment 62 is also hingedly attached to the bottom wail 22 of compartment 15 through a living hinge 36. Accordingly, the bottom wall 22 of compartments 61 and 62 and extension 68 are all formed from the same unitarily molded sheet of plastic 34 as the hinges 36 and bottom walls 22 connected to compartments 15–21.

When spirally rolling the row of compartments into a closed block, the lid 64 is first shut to enclose compartment 61 so that the lid abuts the top surface of inner-most side wall 70. The lid 64 is wider than the open upper side of compartment 61, and a portion 72 of the lid 64 overhangs the side wall 70. Compartment 61, along with extension 68 is pivoted on the living hinge 36 to fittingly engage with the compartment 62, wherein the side wall 70 of compartment 61 covers the open upper side of compartment 62. Furthermore, extension 68 lies adjacent to and abutting the outermost surface of the side wall 74 of compartment 62. The overhanging portion 72 of the lid 64 extends into compartment 62 and engages the inner surface of the innermost side wall 76 of compartment 62. Subsequently, compartment 62 is pivoted about living hinge 36 until the side edges 28 of the end wall 26 of compartment 62 come to abut the adjoining side edge 28 of the end wall 26 of compartment 15, while the lid 64 of compartment 61 covers the open upper side of compartment 15. The remaining compartments are continued to be spirally wound in a similar fashion as in the previously described embodiment, until the trapezoidal closed block is obtained.

The preferred embodiment of the present invention shown in FIGS. 4 and 5 also employs the elongated flanges 50 and grooves 52 described above. Compartment 61 includes elongated grooves 52 formed in its end wall 26 adjacent to its open upper side, outermost side wall 66 and bottom wall 22 for receiving elongated flanges 50 extending from the end walls 26 of compartment 15, compartment 16 and compartment 17, respectively. Compartment 62 includes elongated grooves 52 formed in its end walls 26 adjacent to outermost side wall 74 and bottom wall 22 for receiving elongated flanges 50 extending from the end walls 26 of compartments 17 and 18, respectively. Therefore, the elongated flange 50 extending from the end wall 26 of compartment 17 extends across the adjacent elongated grooves 52 of both compartment 61 and compartment 62.

The spirally wound trapezoidal block shown in FIG. 4 provides a wider base compartment 21 than the block shown in FIG. 2, so that the trapezoidal shape provides an extremely stable rollable storage device 60 which is resistant to being knocked over accidentally. Furthermore, construction of the preferred embodiment allows all of the bottom walls 22 and hinges 36 to be formed from the same unitary sheet of plastic material 34, which also produces a more sturdy rollable storage device 60 where the hinges 36 do not allow the compartments to shift with respect to one another and do not deteriorate over continued use.

The above-described embodiments of the present invention also allow the rollable storage device to be manufactured in an one step molding process. Since all of the bottom walls 22 are formed from the same unitary sheet of plastic material which extends beneath all of the compartments, the entire storage device may formed from a single mold. The single mold preferably includes two plates, an upper plate and a lower plate, which when placed together form the shape of the extended rollable storage device in the space therebetween. The heated plastic material is placed within the mold to form the compartments of the rollable storage device, wherein a single, unitary sheet 34 of the plastic material extends across the entire mold so that it will extend beneath all of the compartments. The unitary sheet of plastic material 34 may have portions selectively thinned during the molding process to form hinges 36, or, alternatively, the sheet of plastic material 34 may be selectively scored after the mold is formed to form hinges 36. This provides a simple, uncomplicated method of manufacturing the rollable storage device where all of the compartments are formed together from the same mold and do not need to be assembled together in a later step.

What is claimed is:

1. A rollable storage device having multiple compartments comprising:

a plurality of compartments for storing objects therein; each compartment including a bottom wall, a pair of side walls, and a pair of end walls; said pair of side walls and end walls extending outwardly from said bottom wall;

each of said end walls being substantially parallel to and having a height equal to said other end wall of said pair of end walls within each compartment; a minority of said compartments having end walls with the same height as said end walls of other compartments; said end walls having a predetermined length and thickness; said pair of end walls in each compartment having a height greater than the height of the pair of side walls in the same compartment;

said bottom walls of said compartments being hingedly interconnected to form a unitary continuous row of compartments; at least a majority of said bottom walls being formed from a unitarily molded sheet of plastic material extending beneath a majority of said compartments;

said compartments having open upper sides opposite said bottom wall;

said row of hingedly interconnected compartments having a first end and a second end; said row of compartments being rollable between a first extended open position in which said compartments rest on their bottom walls with said upper sides of said compartments turned upwardly, and a second, rolled-up closed position in which said compartment row, beginning from said first end, has been spirally wound from said first position to form a substantially closed block, as each of said compartments is rolled toward said second end each compartment is in abutting relation to the adjacent compartment hingedly connected thereto; each of said open upper compartment sides is matingly covered by the bottom wall of a compartment situated radially inwardly thereof in said spirally wound block;

each of said end walls of said compartments, except for the first two compartments at said first end of said row of compartments, including an elongated flange extending across the majority of the length of the top of said end wall; said elongated flange having a thickness less than the thickness of the remainder of said end wall;

said elongated flanges being fittingly received within corresponding elongated grooves formed in a lower side of the corresponding end wall of a compartment lying inwardly of and abutting said flange containing compartment in the spirally wound block; said elongated flanges and elongated grooves being shaped so as to engage one another when said row of compartments is rolled up and to disengage when said row of compartments is unrolled.

2. The rollable storage device of claim 1, wherein all of said bottom walls of said compartments are formed from the same unitarily molded sheet of plastic material providing a unitary wall extending across said entire row of compartments; said first two compartments on said first end of said row of compartments having their adjacent side walls and their bottom walls formed from said unitarily molded sheet of plastic material.

3. The rollable storage device of claim 1, wherein the substantially closed block is asymmetrical with at least 59% of said storage device being located in the lower half of said closed block.

4. The rollable storage device of claim 1, wherein said end walls and said side walls of said compartments comprise side edges, said side edges of said side walls being connected to the side edges of the end walls within the same compartment so that the side walls of each compartment are parallel to the side edges of the end walls within the same compartment.

5. A rollable storage device having multiple compartments comprising:

a plurality of compartments for storing objects therein; each compartment including a bottom wall, a pair of side walls, and a pair of end walls; said pair of side walls and end walls extending outwardly from said bottom wall;

each of said end walls being substantially parallel to and having a height equal to said other end wall of said pair of end walls within each compartment; a minority of said compartments having end walls with the same height as said end walls of other compartments; said end walls having a predetermined length and thickness; said pair of end walls in each compartment having a height greater than the height of the pair of side walls in the same compartment;

said bottom walls of said compartments being hingedly interconnected to form a unitary continuous row of compartments; at least a majority of said bottom walls being formed from a unitarily molded sheet of plastic material extending beneath a majority of said compartments;

said compartments having open upper sides opposite said bottom wall;

said row of hingedly interconnected compartments having a first end and a second end; said end compartment on said first end including a lid hingedly interconnected thereto which covers said open upper side of said end compartment;

said row of compartments being rollable between a first extended open position in which said compartments rest on their bottom walls with said upper sides of said compartments turned upwardly, and a second, rolled-up closed position in which said compartment row, beginning from said first end, has been spirally wound from said first position to form a substantially closed trapezoidal block, as each of said compartments is rolled toward said second end each compartment is in abutting relation to the adjacent compartment hingedly connected thereto; each of said open upper compartment sides is matingly covered by a bottom wall, side wall or lid of a compartment situated radially inwardly thereof in said spirally wound block;

each of said end walls of said compartments, except for the first two compartments at said first end of said row of compartments, including an elongated flange extending across the majority of the length of the top of said end wall; said elongated flange having a thickness less than the thickness of the remainder of said end wall;

said elongated flanges being fittingly received within corresponding elongated grooves formed in a lower side of the corresponding end wall of a compartment lying inwardly of and abutting said flange containing compartment in the spirally wound block; said elongated flanges and elongated grooves being shaped so as to engage one another when said row of compartments is rolled up and to disengage when said row of compartments is unrolled.

6. The rollable storage device of claim 5, wherein all of said bottom walls of said compartments are formed from the same unitarily molded sheet of plastic material providing a unitary wall extending across said entire row of compartments.

* * * * *